United States Patent [19]

Booth et al.

[11] Patent Number: 4,678,448

[45] Date of Patent: Jul. 7, 1987

[54] KINESCOPE FUNNEL THUMPER AND FLUSH DEVICE

[75] Inventors: David E. Booth, New Providence; Steven G. Smith, Harrisburg; John L. Adams, Sinking Springs, all of Pa.

[73] Assignee: RCA Corporation, Princeton, N.J.

[21] Appl. No.: 855,601

[22] Filed: Apr. 25, 1986

[51] Int. Cl.[4] ..... H01J 9/38

[52] U.S. Cl. ..... 445/60; 445/59

[58] Field of Search ..... 445/59, 60, 62, 72, 445/5, 71, 67

[56] References Cited

U.S. PATENT DOCUMENTS 3,712,699 1/1973 Syster ..... 445/59 X 4,445,874 5/1984 D'Augustine ..... 445/67 X 4,605,379 8/1986 Shahan ..... 445/59

*Primary Examiner*—Kenneth J. Ramsey

*Attorney, Agent, or Firm*—E. M. Whitacre; D. H. Irlbeck; L. L. Hallacher

[57] ABSTRACT

A device for thumping and flushing a kinescope funnel includes a lift member which moves horizontally to engage the funnel and then vertically to raise the funnel to a thump position. A means for centering and orienting the neck moves in unison with the lift member. A thumper is arranged to thump the funnel in the thump position. A probe vertically moves to enter the funnel through the neck and inject a flushing fluid into the funnel while thumping occurs.

11 Claims, 8 Drawing Figures

KINESCOPE FUNNEL THUMPER AND FLUSH DEVICE

BACKGROUND

This invention relates generally to the production of kinescopes and particularly to an apparatus for thumping and fluid flushing kinescope funnels to reduce blocked apertures and electron gun shorts in such kinescopes.

The kinescope, or picture tube, for a color television receiver includes a phosphor screen which is composed of alternating stripes of phosphors, each of which emits a different color of light when impacted by electrons. The phosphor stripes are produced on the faceplate panel by coating the inside surface of the panel with a slurry of one of the phosphors. A thin metal apertured shadow mask, which is supported on a sturdy metal frame, is inserted into the panel. The panel is fritted onto a funnel, and an electron gun is mounted in the neck of the funnel. The funnel is then evacuated and sealed.

In the operation of a kinescope, an electron beam is provided for each of the three primary colors red, green and blue. The three electron beams converge at the shadow mask and pass through the apertures in the shadow mask so that each beam impacts a phosphor of the proper light emitting color. The shadow mask apertures are quite small and therefore small airborne contaminants, such as glass particles, metal flakes, dust particles, small fibers, etc. can easily block an aperture and cause a dark spot on the kinescope screen during the operation of the tube. Additionally, during the operation of the kinescope, the screen and the shadow mask within the panel/frame assembly are scanned by electrons so that any particles which previously adhered to the screen or shadow mask are charged with a negative polarity. The screen and shadow mask are operated at a high positive potential so that the charged particles have a tendency to adhere to the shadow mask, thereby greatly increasing the probability of blocked apertures. The panels and funnels are fritted together by heating them to an elevated temperature in a lehr. When the funnels leave the lehr they cool and pull air in. This greatly enhances the possibility of airborn particles being pulled in and causing blocked apertures. For these reasons there is a need for an apparatus for removing the maximum number of small particles from the funnels of kinescopes prior to the insertion of the electron gun into the funnels. The instant invention is directed to such an apparatus.

CROSS REFERENCE TO RELATED APPLICATION

This invention can be used with the invention described in application Ser. No. 769,977, U.S. Pat. No. 4,605,379, entitled "Kinescope Panel/Mask Frame Assembly Thumper And Flush Device And Method" filed Aug. 27, 1985 by Donald J. Szahan, the disclosure of which is incorporated herein by reference.

SUMMARY

A device for simultaneously thumping and flushing a kinescope funnel is situated in the proximity of a conveyance mechanism whereby the device removes the funnel from, and replaces the funnel on, the conveyance mechanism including funnel lift means which is horizontally movable between an empty position and a lift position, and which is vertically moveable between the lift position and a thump position. A neck centering and orienting means is arranged to move in unison with the funnel lift means. The neck centering and orienting means is configured to engage the neck to substantially center the neck with respect to a vertical axis, and to orient the neck substantially parallel to the vertical. A fluid injection means is arranged to move vertically along the axis to inject fluid into the funnel when the funnel is in the thump position. A thumper means is arranged to thump the faceplate when the funnel is in the thump position.

DETAILED DESCRIPTION

Figure 1:
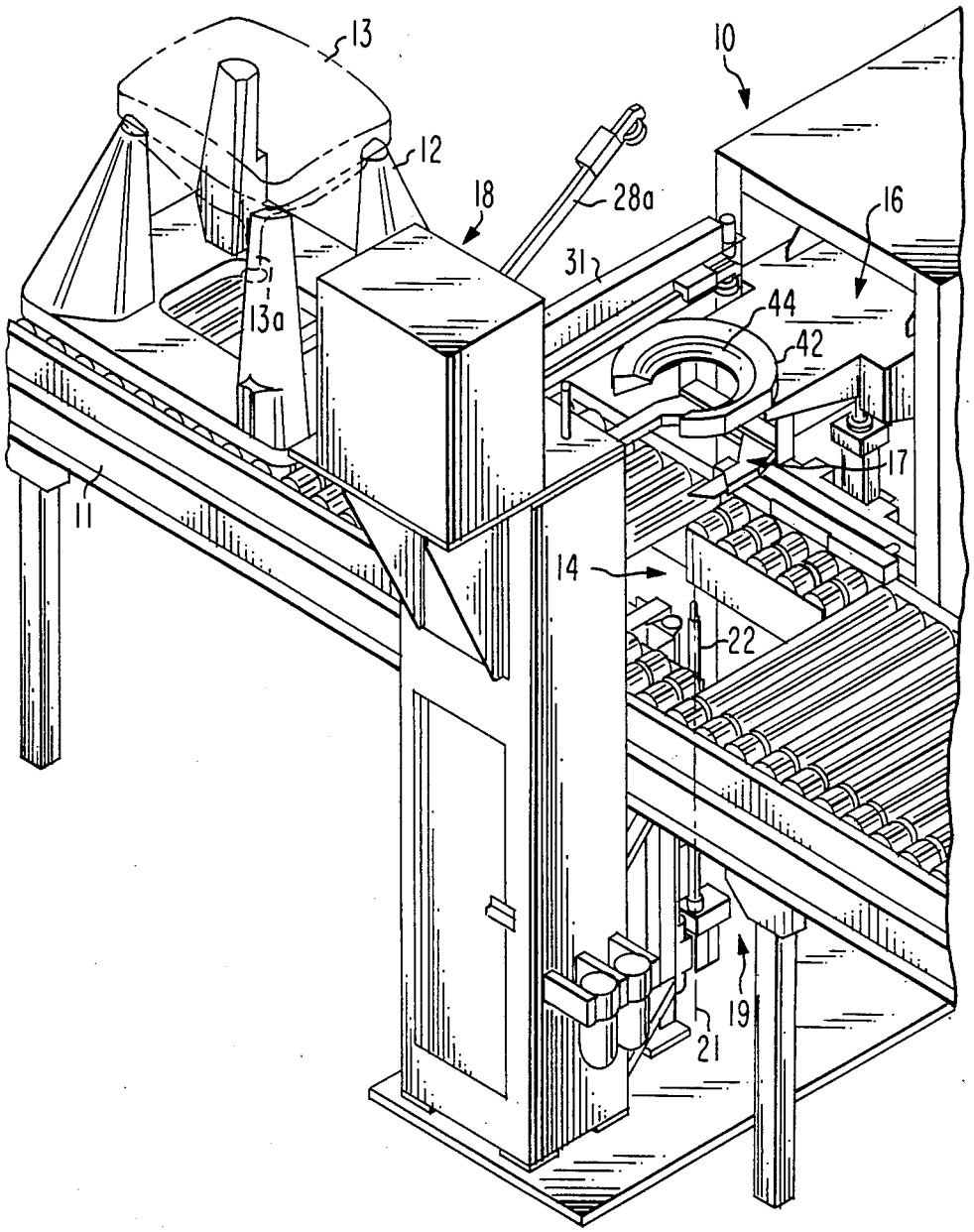
FIG. 1 is an isometric view of a preferred embodiment positioned with respect to a conveyor system.

In FIG. 1, a kinescope funnel thumper and flush device 10 is positioned with respect to a conveyor system 11. A funnel carrier 12 carries a kinescope funnel 13, shown in phantom, to a funnel lift position 14. The thumper and flush device 10 includes a funnel lift 16 which is horizontally movable between an empty position and the lift position 14. The lift mechanism 16 also is vertically movable between the lift position 14 and a thump position directly above the lift position. The funnel lift mechanism 16 is shown in more detail in FIG. 3. A neck centering and orienting device 17 is arranged to move horizontally and vertically in unison with the funnel lift mechanism 16. The neck centering and orienting mechanism 17 is shown in more detail in FIG. 6. A thumper mechanism 18 is arranged above the lift position 14 of the conveyor 11. The thumper mechanism 18 is shown in more detail in FIG. 4 and in copending U.S. application Ser. No. 769,997 fully referenced hereinabove. A fluid injection mechanism 19 is arranged beneath the lift position 14 and is shown in more detail in FIG. 2.

In operation, the funnel carrier 12 moves along the conveyor 11 supporting the funnel 13 with the neck **13*a* facing downwardly. The transverse position of the carrier 12 on the conveyor 11 is not critical and the orientation of the funnel 13 on the carrier 12 also is not critical. When the carrier 12 reaches the lift position 14, the carrier is sensed by a sensing mechanism, such as a limit switch or a photoelectric device (not shown). The carrier is then stopped at the lift position. The lift mechanism 16 moves horizontally from an empty position to the lift position 14. The lift mechanism 16 moves upwardly, in the first stage of vertical motion and engages the funnel 13 on the curved portion of the funnel above the neck 13*a*. The neck centering and orienting device 17 is actuated to close on the neck 13*a* of the funnel 13 to precisely coincide the longitudinal axis of the neck 13*a* with respect to a horizontally fixed vertical axis 21**.

The funnel lift 16 and the neck centering device 17 then move upwardly in unison, in the second stage of vertical motion, to place the funnel 13 at a thump position in the proximity of the thumper mechanism 18. The funnel 13 is then positioned as shown in phantom in FIG. 2. The flush device 19 is moved vertically along the vertical axis 21 and the flush mechanism passes through the neck 13*a* into the funnel 13. The thumper mechanism 18 is then actuated to thump the outside surface of the faceplate of the funnel 13 simultaneously with the injection of fluid into the interior of the funnel. The thumping tends to free any loose particles clinging to the phosphor screen, the shadow mask, or any other components within the funnel. The injection of pressurized fluid into the funnel causes loose particles to be blown outwardly through the neck 13*a*. Preferably, the fluid injected into the funnel is ionized so that charged particles are neutralized and can no longer cling to any internal component of the funnel 13. After the thumping and flushing have proceeded for a preselected time, the fluid injection mechanism 19 is removed from the funnel. The funnel is lowered to the lift position 14 and placed back onto the carrier 12. The neck centering and orienting device 17 is opened to release the neck 13*a* and the funnel lift device 16 and centering mechanism 17 move horizontally in unison to the empty position. The carrier 12 and funnel 13 are then free to move along the conveyor 11 to the next processing station.

Figure 2:
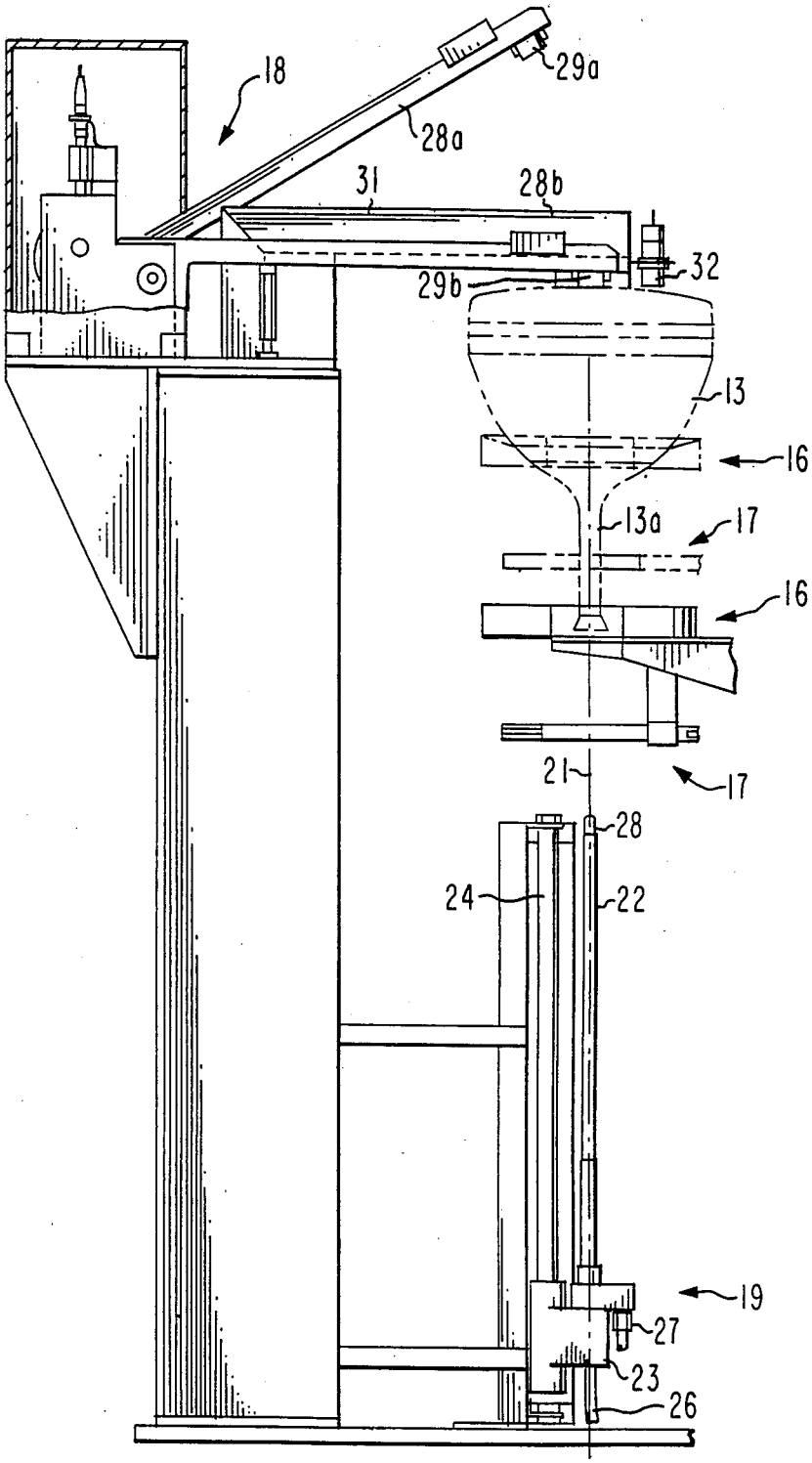
FIG. 2 is a side view, showing the relative positions of a thumper mechanism and a flush mechanism.

In FIG. 2, portions of the funnel lift 16 and neck centering and orienting device 17 are shown in the lift position 14 in solid lines. After the neck orienting and centering mechanism 17 closes on the neck 13*a* of the funnel to accurately align the longitudinal axis of the neck 13*a* along the fixed vertical axis 21, the funnel is raised to the thump position shown in phantom lines.

The fluid injection mechanism 19 includes an elongated hollow probe 22, the longitudinal axis of which is aligned with the fixed vertical axis 21. The probe 22 is described in detail hereinafter with reference to FIGS. 7 and 8. The probe is mounted on a slide bearing 23 which slides on a vertical shaft 24 in response to the injection of a fluid, such as air into an inlet coupling 26. The flushing fluid is injected through inlet couplings 26 and 27 and passes through the hollow probe 22 and exits through an apertured end 28. The vertical movement of probe 22 is limited by the length of the shaft 24 so that the probe is elevated a fixed height upon actuation. Because both the probe 22 and the neck 13*a* are centered about, and are parallel to, the vertical axis 21, the probe end 28 passes through the neck 13*a* and enters the funnel to flood the interior of the funnel 13 with the flushing fluid.

The thumper mechanism 18 includes two arms 28*a* and 28*b* which have thumpers 29*a* and 29*b* on the free ends, respectively. The arms 28*a* and 28*b* alternately impact the outside surface of the funnel to disengage particles within the enevelope 13 which could otherwise be jarred loose during processing, shipping and other handling. The thumper mechanism 18 includes a cantilever beam 31, having a funnel sensor 32 mounted on the distal end. The sensor 32 can be a limit switch or an optical sensor, and senses the surface of the funnel 13 to cause the funnel lift 16 to stop moving vertically. Accordingly, envelopes of all sizes can be processed in the inventive system.

Figure 4:
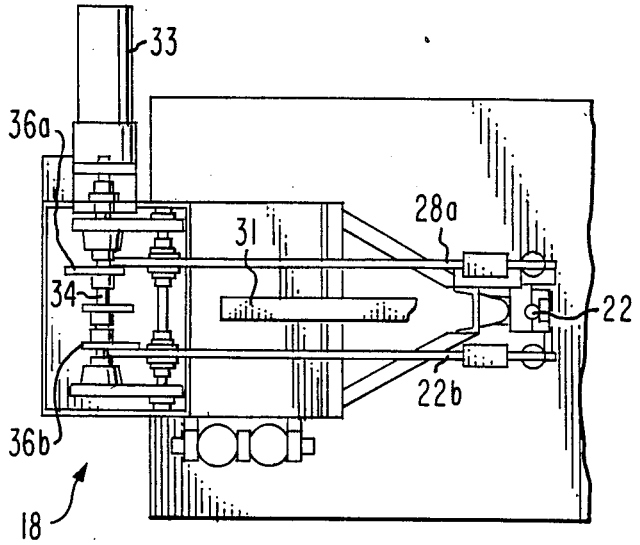
FIG. 4 is a top view of the thumper mechanism of FIG. 2.

In FIG. 4, the thumper mechanism 18 includes a motor 33 which rotates a shaft 34 upon which cams 36*a* and 36*b* are fixed. The cams are configured to cause the arms 28*a* and 28*b* to alternately move up and down causing the thumpers 29*a* and 29*b* to alternately thump the surface of the funnel 13. The details of a thumper mechanism which can be used are fully presented in U.S. application Ser. No. 769,977 fully referenced hereinabove.

Figure 3:
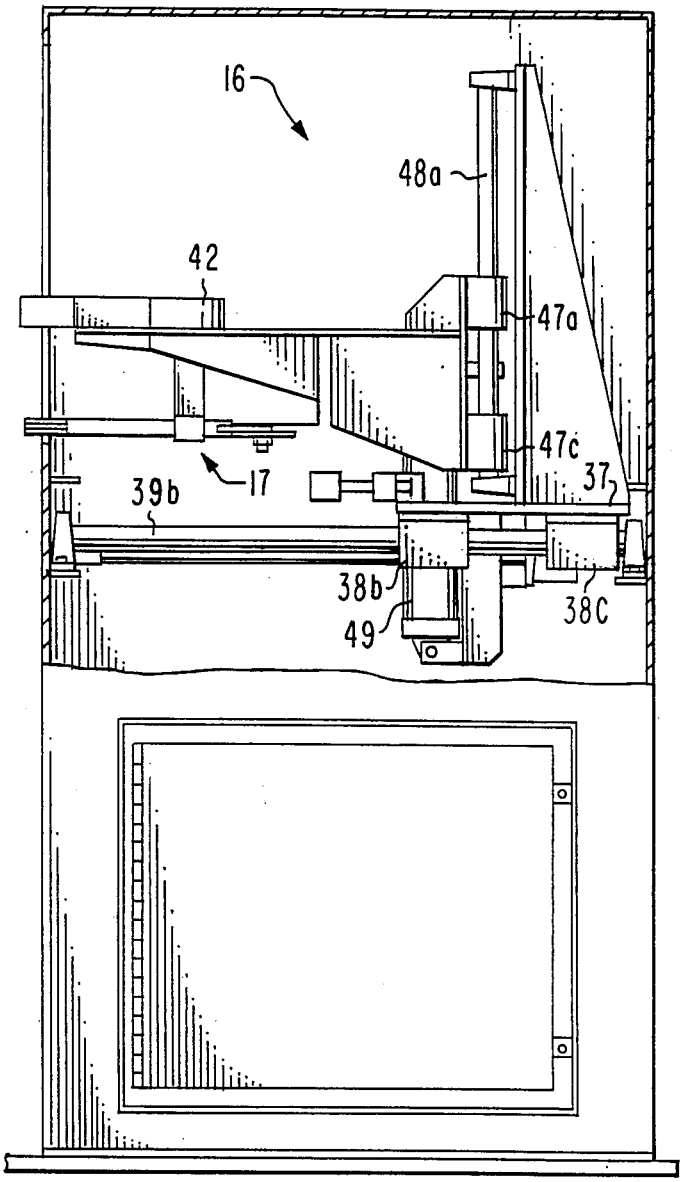
FIG. 3 is a side view of a funnel lift mechanism.
Figure 5:
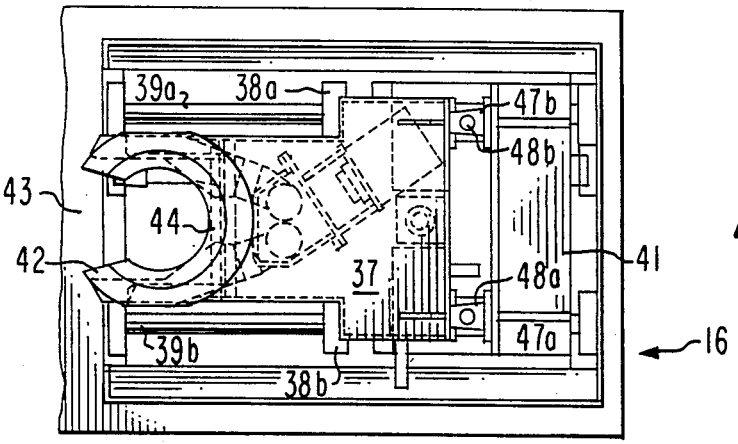
FIG. 5 is a top view of the funnel lift mechanism in an empty position.

In FIGS. 3 and 5, the funnel lift mechanism 16 is shown in the empty position. The lift mechanism 16 includes a slidable platform 37 which is affixed to slide bearings 38*a* and 38*b* and 38*c*. The slide bearings 38*a*, 38*b* and 38*c* slide on horizontal, parallel slide shafts 39*a* and 39*b*, which both guide and stabilize the platform 37. A fourth slide bearing on the shaft 39*a* is not shown. A cylinder 41, which can be pneumatic or hydraulic, is fixed to the support cabinet and includes a movable shaft which is coupled to the platform 37. Accordingly, upon actuation of the cylinder 41 the platform 37 carries the lift mechanism 16 horizontally for a distance determined by the lengths of the slide shafts 39*a* and 39*b*, at which point the lift mechanism is in the funnel lift position 14. The lift mechanism includes a funnel support element 42 which is substantially circular and contains an open portion 43. The inside surface of the support element 42 is beveled, as shown at 44. The open portion 43 allows the support element 42 to pass beneath the funnel section of the funnel and around the neck 13*a*. The bevel 44 is angled to receive the diverging sides of the funnel immediately above the neck 13*a* so that tubes of all size and configuration can be lifted by the mechanism. The neck centering and orienting mechanism 17 is affixed to the support element 42, as by a convenient connecting member 46.

In FIG. 5, the funnel support element 42 is also coupled to slide bearings 47*a* and 47*b* which, respectively, are arranged to slide on vertical shafts 48*a* and 48*b*. In FIG. 3, an additional slide bearing 47*c* is shown coaxial with the vertical shaft 48*a*, a fourth slide bearing on the shaft 48*b* is not visible. A vertically arranged cylinder 49 has a movable element (not shown) coupled to the platform 37. Upon actuation of the cylinder 49, the slide bearings 47*a*, 47*b* and 47*c*, slide on the guide shafts 48*a* and 48*b* to raise the funnel support element 42 and the neck centering and orienting device 17, vertically to position a funnel in the thumping position. The shafts 48*a* and 48*b* have sufficient length to enable both large and small tubes to be elevated to the lift position until sensed by the sensor 32 (FIG. 2).

Figure 6:
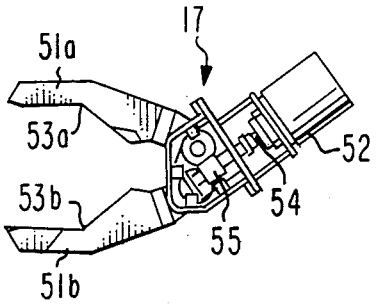
FIG. 6 shows the neck centering and orienting mechanism in more detail.

In FIG. 6, the neck centering and orienting mechanism 17 includes pivotable arcuate blades 51*a* and 51*b*. The blades 51*a* and 51*b* are curved to face one another and are coupled, by a gear mechanism 55, to the shaft 54 of a motor 52. Upon actuation of the motor 52, the blades 51*a* and 52*b* close toward one another in scissors fashion. The inside edges of blades 51*a* and 51*b* each include an angle 53*a* and 53*b*, respectively. As the blades 51*a* and 51*b* close toward one another, the sides of the angles 53*a* and 53*b* form a four sided closing aperture the center of which is coincident with the vertical axis 21. Accordingly, the neck 13*a* of the funnel 13 is urged toward the fixed vertical axis 21 by the internal sides of the blades 51*a* and 51*b* irrespective of the position, orientation or tilt of the neck 13*a* when the mechanism 17 is initially actuated. The closing of the blades 51*a* and 51*b* can be limited by proximity sensors or by sensing the pressure build up within the motor 52 which occurs when the blades have closed against the neck 13*a* and are no longer movable.

Figure 8:
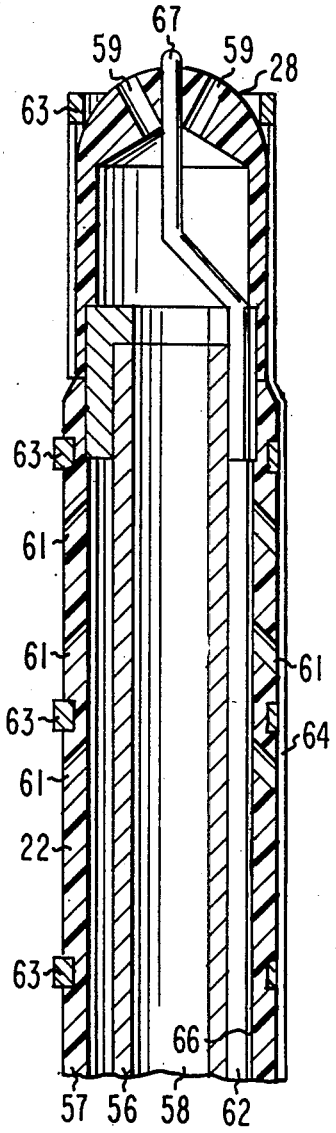
FIG. 8 is a cross section of the distal end of the probe.
Figure 7:
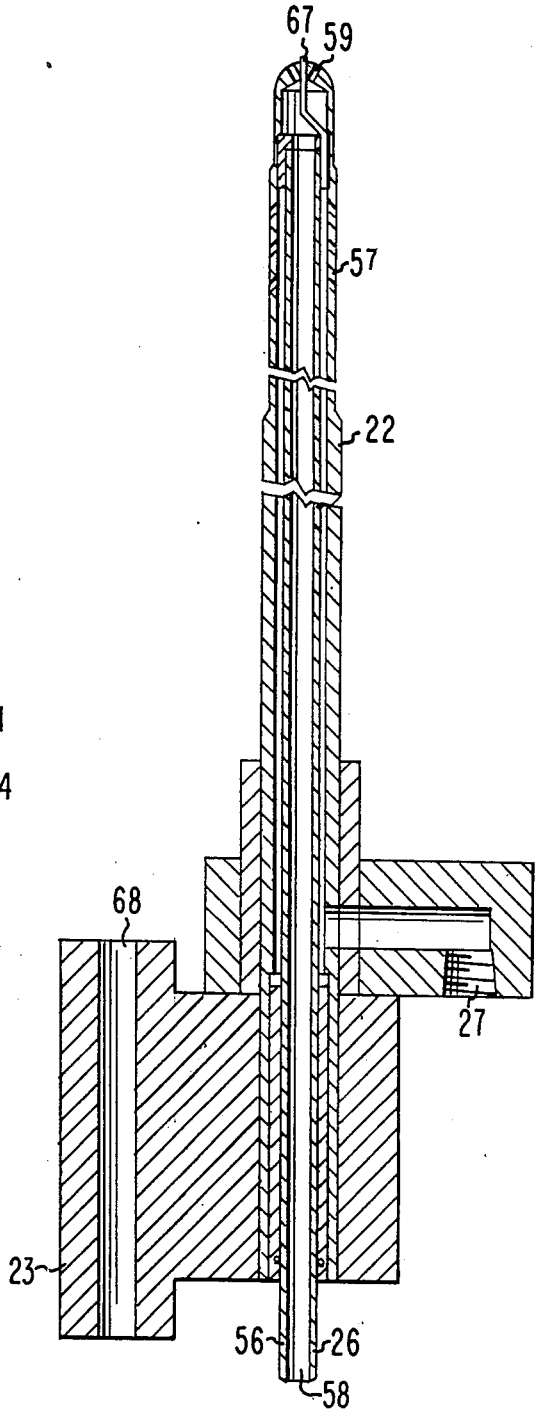
FIG. 7 is a cross section of a flushing probe.

In FIGS. 7 and 8, the probe 22 includes concentric cylinders 56 and 57. The motor cylinder 57 is made from an insulative material, such as polyvinyl chloride, PVC. The inner cylinder 56 includes a bore 58. Fluid is supplied to the cylinder 56 through the coupling 26 and exits through an aperture 59 in the distal end 28. The outer cylinder 57 includes apertures 61, which face downwardly from the bore 58. The inside diameter of the cylinder 57 exceeds the outside diameter of the cylinder 56 to form a fluid passage 62 with which the apertures 61 communicate. Fluid is supplied to the fluid passage 62 by the coupling 27. The slide bearing 23 includes a slide bore 68 through which the shaft 24 (FIG. 2) passes.

Electrically conductive rings 63 are arranged coaxial about the probe 22. The rings 63 are electrically connected by a conductive line 64. A thin conductive member 66 is arranged in the passage 62 and is electrically connected to a conductor 67 which extends through the end 28 of the probe 22. The conductors 64 and 66 are connected to an appropriate voltage source (not shown) to place a voltage on the rings 63 and the conductor 67. Accordingly, fluid passing through either the apertures 59 or 61 passes through a corona and is charged, or ionized.

During operation, as the probe 22 enters the neck 13*a* of the tube 13, fluid is injected into the tube through the bore 58 and the aperture 59. This fluid moves upwardly and outwardly to sweep the faceplate and shadow mask of the tube to remove loose particles from within the tube. After the probe 22 reaches the highest position and starts downwardly a fluid to the bore 58 is halted and fluid is admitted to the passage 62 through the coupling 27. This fluid exits through the downwardly sloped apertures 61 and thus establishes a sweeping action within the tube 13 to flush loose particles from the tube.

What is claimed is:

1. A device for simultaneously thumping and flushing a kinescope funnel having a faceplate and a neck, said device being situated in the proximity of a conveyance mechanism whereby said device removes said funnel from, and replaces said funnel on, said conveyance mechanism, said device comprising:

funnel lift means, said funnel lift means being horizontally moveable between an empty position and a lift position, and vertically moveable between said lift position and a thump position; whereby said funnel lift means moves horizontally into engagement with a funnel and vertically to position said funnel at said thump position;

neck centering and orienting means arranged to move in unison with said funnel lift means, said neck centering and orienting means being configured to engage said neck to substantially center said neck with respect to a vertical axis, and to orient said neck substantially parallel to said axis;

fluid injection means arranged to move vertically along said axis to inject fluid into said funnel when said funnel is in said thump position; and thumper means arranged to thump said faceplate when said funnel is in said thump position.

2. The device of claim 1 wherein said vertical axis is horizontally fixed.

3. The device of claim 2 wherein said fluid injection means is a hollow, elongated probe, having a longitudinal axis coincident with said vertical axis.

4. The device of claim 3 wherein said neck centering and orienting means includes two pivotable arcuate blades having inside edges cofigured to form a closing aperture as said blades close toward one another whereby said blades engage said neck and substantially center said neck substantially parallel to said vertical axis.

5. The device of claim 4 wherein said funnel lift means includes a funnel support element having an open portion and an interior bevel configured to engage funnels of various configurations.

6. The device of claim 5 wherein said fluid ionized.

7. The device of claim 6 wherein said probe includes coaxial cylinders, said cylinders being dimensioned to form a fluid passage between said cylinders, the inner cylinder having a fluid bore communicating with apertures for injecting upwardly flowing fluid into said funnel, the outer cylinder having downwardly slanted apertures communicating with said fluid passage for injecting downwardly flowing fluid into said funnel.

8. The device of claim 7 further including means for ionizing fluid exiting from said apertures.

9. The device of claim 3 wherein the distance of horizontal motion is a preselected distance and further including funnel sensor means for sensing said funnel in said thump position to limit said vertical motion.

10. The device of claim 3 wherein said probe includes coaxial cylinders, said cylinders being dimensioned to form a fluid passage between said cylinders, the inner cylinder having a fluid bore communicating with apertures for injecting upwardly flowing fluid into said funnel, the outer cylinder having downwardly slanted apertures communicating with said fluid passage for injecting downwardly flowing fluid into said funnel.

11. The device of claim 1 wherein the distance of horizontal motion is a preselected distance, and further including funnel sensor means for sensing said funnel in said thump position to limit said vertical motion.

* * * * *